US008113263B2

(12) United States Patent
Reed et al.

(10) Patent No.: US 8,113,263 B2
(45) Date of Patent: Feb. 14, 2012

(54) BARRIER OPERATOR WITH MAGNETIC POSITION SENSOR

(75) Inventors: Brett A. Reed, Alliance, OH (US); Ralph C. Angiuli, Canfield, OH (US)

(73) Assignee: Overhead Door Corporation, Farmers Branch, TX (US)

( * ) Notice: Subject to any disclaimer, the term of this patent is extended or adjusted under 35 U.S.C. 154(b) by 487 days.

(21) Appl. No.: 11/171,539

(22) Filed: Jun. 30, 2005

(65) Prior Publication Data

US 2007/0000622 A1 Jan. 4, 2007

(51) Int. Cl.
*E05F 15/10* (2006.01)

(52) U.S. Cl. ..... 160/188; 160/310; 318/467; 49/29

(58) Field of Classification Search ..... 160/188, 160/310; 49/29; 318/467
See application file for complete search history.

(56) References Cited

U.S. PATENT DOCUMENTS

| | | | | |
|---|---|---|---|---|
| 4,888,531 | A | 12/1989 | Hormann | |
| 4,952,873 | A | 8/1990 | Tellerman | |
| 5,243,784 | A | 9/1993 | Whitaker et al. | |
| 5,311,124 | A | 5/1994 | Hubbard et al. | |
| 5,313,160 | A | 5/1994 | Gloden et al. | |
| 5,689,236 | A | 11/1997 | Kister | |
| 5,929,580 | A * | 7/1999 | Mullet et al. | 318/466 |
| 6,051,947 | A | 4/2000 | Lhotak et al. | |
| 6,070,361 | A | 6/2000 | Paterno | |
| 6,201,364 | B1 * | 3/2001 | Will et al. | 318/466 |
| 6,215,265 | B1 * | 4/2001 | Wolfer et al. | 318/434 |
| 6,369,563 | B1 | 4/2002 | Krahe et al. | |
| 6,414,454 | B1 | 7/2002 | Lhotak et al. | |
| 6,426,604 | B1 * | 7/2002 | Ito et al. | 318/466 |
| 6,545,438 | B1 * | 4/2003 | Mays, II | 318/400.01 |
| 6,755,230 | B2 * | 6/2004 | Ulatowski et al. | 160/84.02 |
| 6,788,048 | B2 * | 9/2004 | Hedayat et al. | 324/202 |
| 6,826,499 | B2 * | 11/2004 | Colosky et al. | 702/85 |
| 7,000,326 | B2 * | 2/2006 | Klarer | 33/203 |
| 7,116,100 | B1 * | 10/2006 | Mock et al. | 324/207.25 |
| 7,138,783 | B2 * | 11/2006 | Ran | 318/653 |
| 7,207,142 | B2 * | 4/2007 | Mullet | 49/199 |
| 2003/0076060 | A1 * | 4/2003 | Colosky et al. | 318/254 |
| 2004/0070391 | A1 * | 4/2004 | Muszynski | 324/207.22 |

* cited by examiner

*Primary Examiner* — Blair M. Johnson
(74) *Attorney, Agent, or Firm* — Gardere Wynne Sewell, LLP

(57) ABSTRACT

A motorized operator for moving a barrier, such as a garage door, between open and closed positions, includes a magnetic sensor for determining position and/or velocity of the barrier. The operator motor is drivingly connected to a speed change transmission which is connected to the barrier. The magnetic sensor includes a housing supporting a speed change mechanism including an output shaft supporting a magnet. The magnet is mounted adjacent a Hall effect sensor circuit which measures the change in the magnetic field generated by the magnet to determine position of the barrier, as well as speed. Control circuitry enables accurate determination of the position of the barrier for setting open and closed limit positions, for example.

9 Claims, 5 Drawing Sheets

BARRIER OPERATOR WITH MAGNETIC POSITION SENSOR

BACKGROUND OF THE INVENTION

Movable barriers, such as upward acting sectional doors, flexible rollup doors, and gates, for example, are typically characterized by operators which include various types of position sensors for use in controlling the barrier and for shutting off the operator motor when the barrier reaches a closed or open limit position, for example. Various types of position sensors have been developed, including mechanical limit switches, optical sensors and electrical devices, such as potentiometers. However, certain prior art barrier operator position sensors lack precision, are subject to mechanical or electrical errors and may require external wiring and devices which are costly to fabricate and install and increase the risk of malfunction of the operator.

Accordingly, there has been a continuing desire and need to provide barrier operators with barrier position sensors which are more reliable, versatile, accurate and less expensive than known types of sensors. It is to these ends that the present invention has been developed.

SUMMARY OF THE INVENTION

The present invention provides a barrier operator, such as a garage door, industrial door, or gate operator, including a controller operable in conjunction with an improved position sensor for determining the position of the barrier for certain purposes, including controlling the operator motor, for example.

In accordance with one aspect of the present invention, a barrier operator is provided with a controller which includes a magnetic position sensor which utilizes a rotating magnetic field to provide an output signal indicating, with precision, the position of the magnetic field and a mechanical element associated therewith. In particular, the operator controller utilizes a travel limit or position sensor which may be associated with a rotatable shaft which, in turn, is associated with or is part of the operator mechanism. The sensor utilizes one or more magnets attached to a shaft, preferably at one end thereof, and disposed in proximity to a two axis Hall effect sensor integrated circuit. The magnet is oriented so that its poles generate a magnetic field parallel to the surface of the circuit, but not in contact therewith. The Hall effect sensors are capable of providing output signals which are directly proportional to the position of the rotating shaft and, hence, the position of a barrier operably connected to the rotating shaft. The angular position of the rotating shaft can be measured by the sensor over a full 360° or one revolution of shaft rotation or more than one full revolution.

Moreover, power may be removed from the controller circuitry and reapplied without loss of a signal associated with the correct position of the shaft. A microcontroller associated with the Hall effect sensors is operable to perform calculations to determine the angular position of the magnetic field and the associated shaft. Data provided by the controller circuitry can include, but is not limited to, absolute position of the barrier, notification of arrival of the barrier at a previously learned position, namely an open or closed travel limit, direction of barrier travel and speed of travel of the barrier being controlled by the operator.

The invention further contemplates the provision of a door operator controller which includes a magnetic position sensor which may be directly connected to a shaft, such as an output shaft of the door operator or an auxiliary shaft operably connected to the output shaft, whereby a substantially direct reading of door or barrier position may be provided. The magnetic sensor is compact, may be mounted unobtrusively on the operator structure and is reliable in operation.

Those skilled in the art will further appreciate the above-mentioned advantages and superior features of the invention, together with other important aspects thereof, upon reading the detailed description which follows in conjunction with the drawings.

DETAILED DESCRIPTION OF PREFERRED EMBODIMENTS

Figure 1:
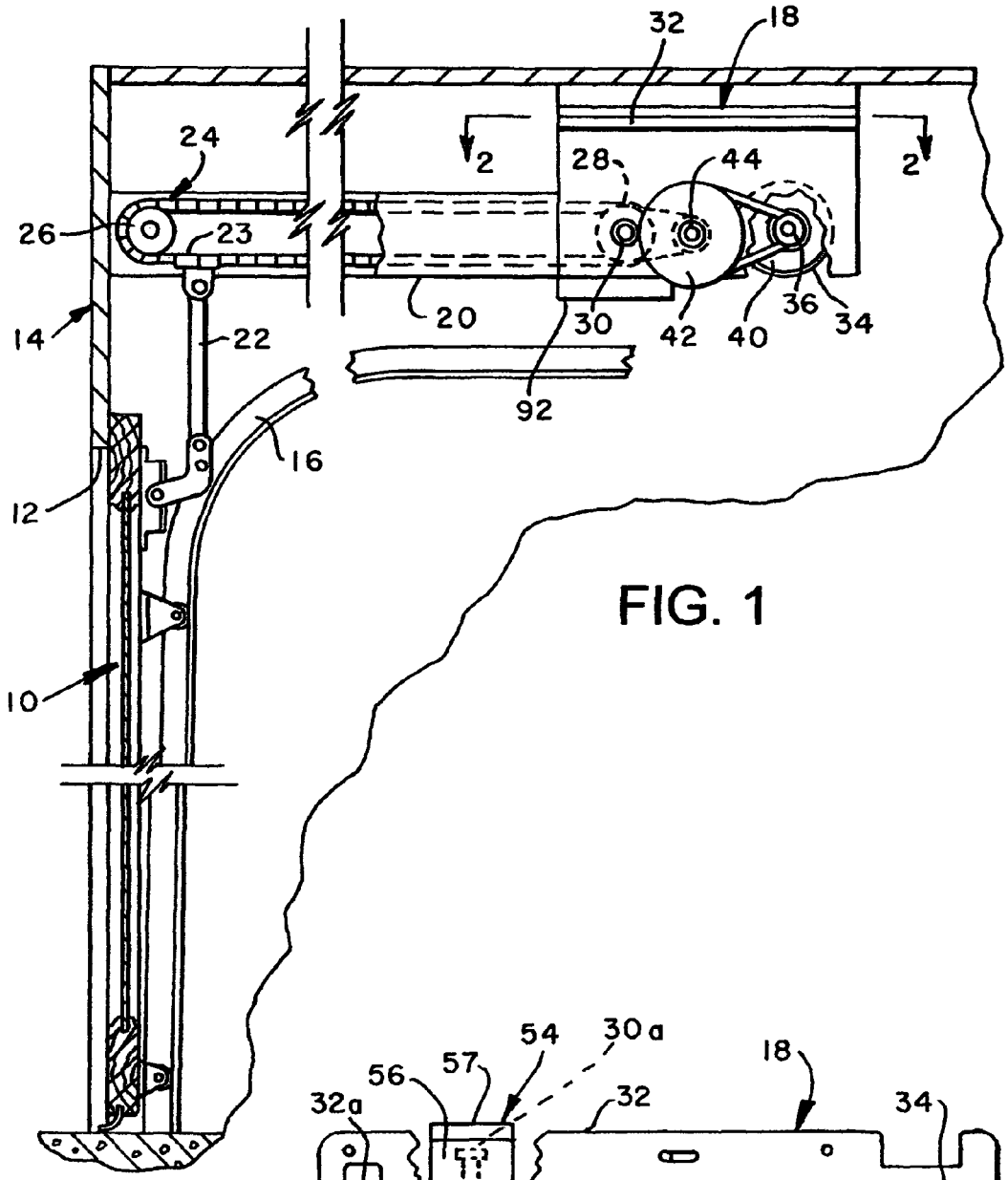
FIG. 1 is a side elevation view, partially sectioned, of an upward acting sectional door connected to an operator which includes a magnetic sensor associated with an operator controller in accordance with the invention.

In the description which follows like elements are marked throughout the specification and drawing with the same reference numerals, respectively. The drawing figures are not necessarily to scale and certain elements may be shown in generalized, schematic or block diagram form in the interest of clarity and conciseness.

Referring to FIG. 1 there is illustrated a movable barrier 10, which may comprise a sectional or one piece upward acting garage door, movable between a closed position shown covering an opening 12 in a structure 14, to an open position along spaced apart guide tracks 16, one shown, in a known manner. The exemplary barrier 10 is connected to a motor driven operator 18 suitably supported by and disposed within structure 14 and connected to an elongated trolley support beam 20, also at least partially, supported by structure 14. Support beam 20 is adapted to support a trolley 22 for traversal therealong in a known manner to move the barrier 10 between open and closed positions. For example, the trolley 22 is illustrated as including a slide 23 connected to an elongated drive chain 24 trained over a rotatable idler sprocket 26 disposed at one end of the beam 20 and also trained over a drive sprocket 28, see FIG. 2 also. Drive sprocket 28 is mounted on and rotatable with an output shaft 30 supported on a frame 32 of operator 18. Opposite ends of the chain 24 are connected to trolley slide 23 in a conventional manner known to those skilled in the art.

Figure 2:
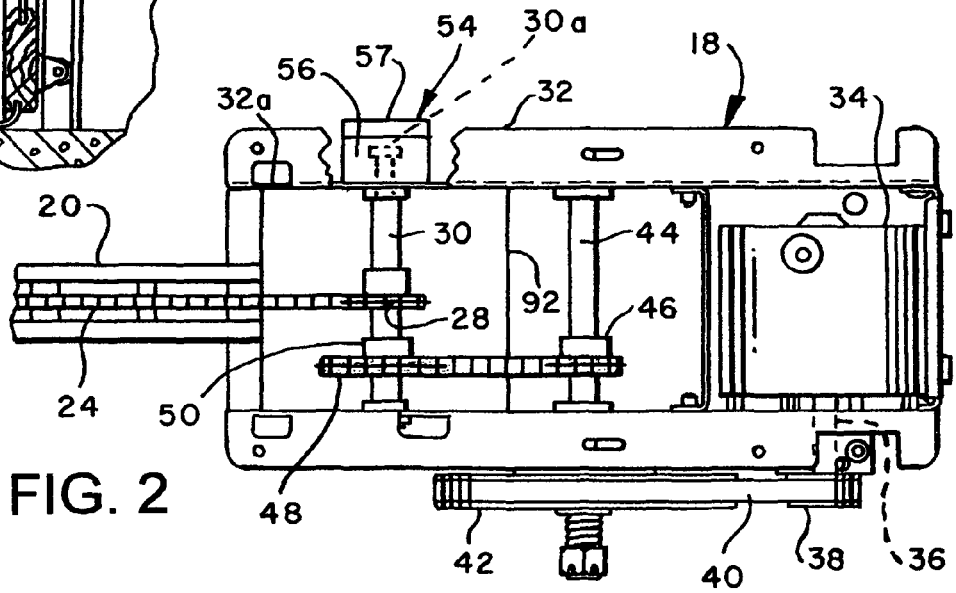
FIG. 2 is a detail plan view taken generally from the line 2-2 of FIG. 1.

Referring to FIGS. 1 and 2, the operator 18 includes an electric drive motor 34 mounted on frame 32 and characterized by a rotatable output shaft 36 having a drive pulley 38 mounted thereon for driving an endless belt 40, which belt is also trained over a pulley 42. Pulley 42 is mounted on and for rotation with a rotatable idler shaft 44 supported on frame 32, which shaft is also drivingly connected to a sprocket 46 interconnected with output shaft 30 by way of an endless chain 48 driving a sprocket 50 secured for rotation with shaft 30. Operator 18 is exemplary of several types of operators which include a drive motor, one or more idler shafts for reducing or increasing the speed of an output shaft, and wherein such output shaft may be connected to a further drive mechanism, such as illustrated and described herein, or connected directly to a drum or roller, for example, for a flexible rollup type door, or to a swing arm for a swing gate, both not shown. Such an output shaft, as described above, may also be connected to a so-called jackshaft for raising and lowering sectional or so-called one piece doors. In all events, the operator 18, and equivalents, typically includes at least one rotatable shaft, the rotation and the position of which is correlatable with the movement and position of a barrier, such as the barrier 10.

Figure 3:
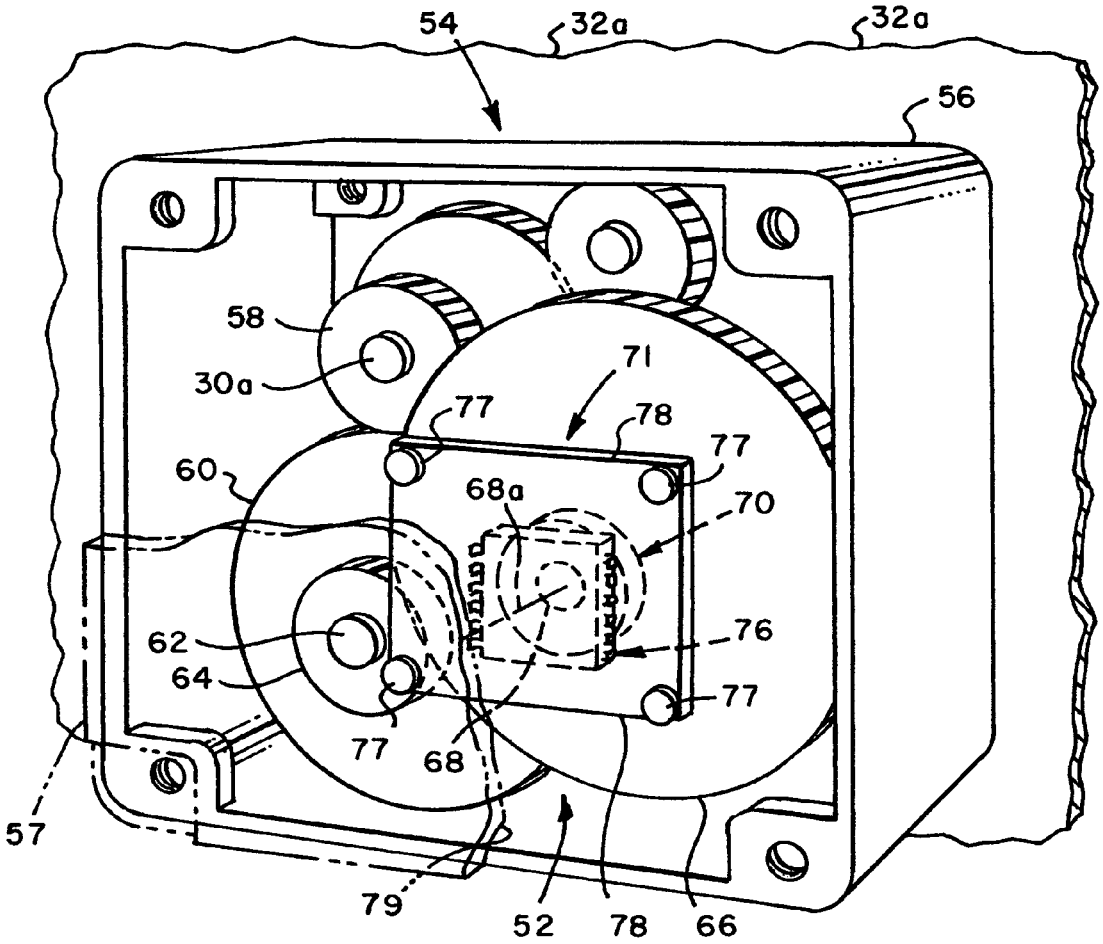
FIG. 3 is a perspective view of a magnetic barrier position sensor in accordance with invention.

In one preferred embodiment of the present invention, the output shaft 30 is provided with a distal end part 30*a*, see FIG. 3 also, which may be part of a gear type speed change mechanism 52 forming part of a magnetic position and speed sensor unit, generally designated by numeral 54. Sensor unit 54 is characterized by a generally rectangular boxlike speed change mechanism housing 56 mounted on a wall part 32*a* of operator frame 32 and enclosing a speed reduction or speed change mechanism for reducing the output speed of shaft 30 to a desired speed and rotational limits between the limits of rotation of the shaft 30 when moving the barrier 10 from a fully closed position, shown in FIG. 1, to a fully open position.

Figure 4:
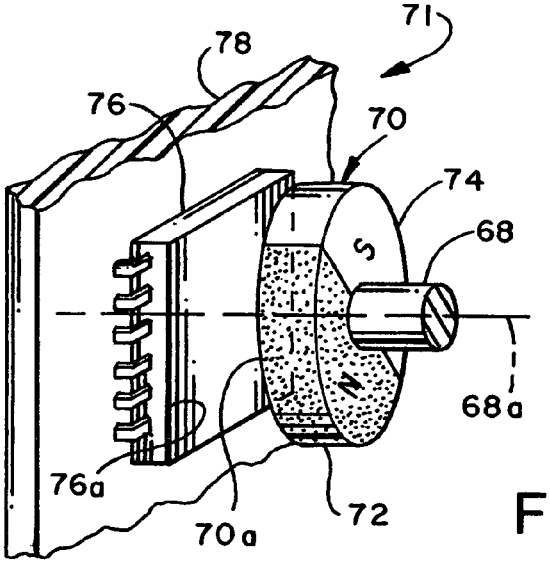
FIG. 4 is a detail perspective view of a major part of the magnetic position sensor.

As shown in FIG. 3, shaft part 30*a*, by way of example, supports a pinion 58 meshed with a gear 60 supported on a rotatable idler shaft 62 which also supports a pinion 64 meshed with a gear 66 supported on and rotatable with a sensor shaft 68, see FIG. 4 also. Shaft 68 supports a generally cylindrical magnet 70 at one end thereof, said magnet having pole pieces 72 (N) and 74 (S). Shafts 62 and 68 are suitably supported within and by housing 56 for rotation therein. Magnet 70 comprises part of a magnetic position sensor 71, FIGS. 3 and 4, which sensor also includes an integrated sensor circuit 76. Magnet 70 is disposed in proximity to integrated sensor circuit 76, see FIGS. 3 and 4, which is mounted on a suitable circuit substrate 78 which, in turn, is preferably mounted on brackets 77 supported on a wall 79 of a cover part 57 of the enclosure or housing 56. Cover 57 is shown as a transparent member, a substantial portion of which is broken away in FIG. 3 for purposes of illustration. Cover 57 is adapted to be removably mounted on housing 56 in a conventional manner. Accordingly, the sensor circuit 76 is mounted in close proximity to the magnet 70 and within a rotatable magnetic field generated by the magnet and the circuit 76 is responsive to rotation of such field. The sensor circuit 76 may be of a type commercially available, such as a Model 2SA-10 manufactured by Sentron AG, Zug, Switzerland. Alternatively, the sensor circuit 76 may also be a type manufactured by Austria Microsystems, AG, Premstatten, Austria, as a type AS5045 Magnetic Rotary Encoder.

The embodiments of the magnetic sensor circuit 76 comprise a two axis Hall effect sensor which is operable to detect the absolute angular position of the magnet 70 as it rotates about the axis 68*a* of shaft 68, FIG. 4, which rotation is correlated directly with rotation of output shaft 30, movement of chain 24 and the actual position of barrier or door 10. The substrate 78 may also support additional circuit elements of the sensor 71, as indicated in FIG. 5.

Figure 5:
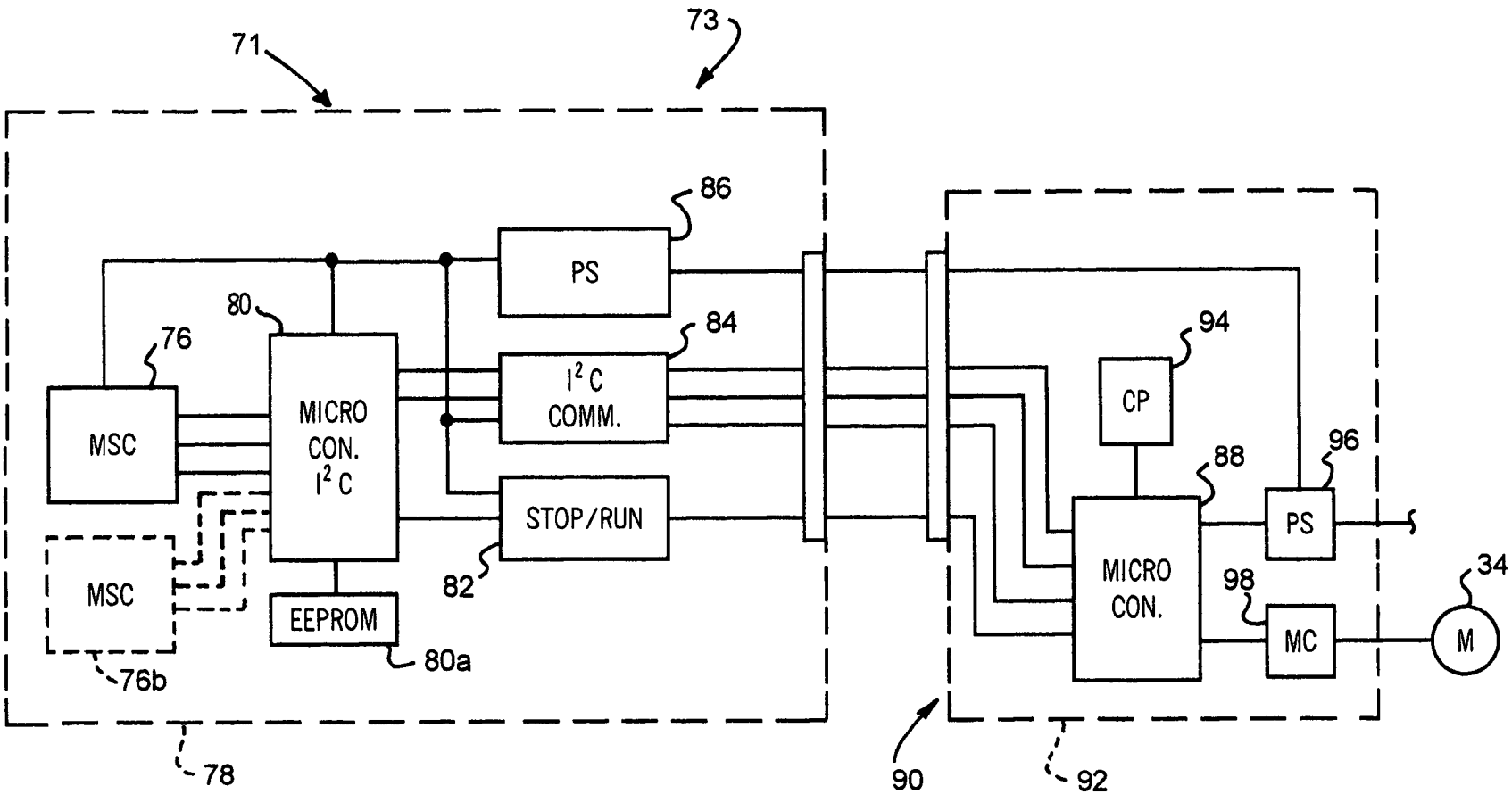
FIG. 5 is a block diagram of a control system for the operator shown in FIGS. 1 and 2 and including a magnetic position sensor in accordance with the invention.

Referring to FIG. 5, there is illustrated a control system 73 which includes the sensor 71. The sensor circuit 76 of sensor 71 is in communication with a microcontroller 80 configured to preferably operate on the inter-integrated circuit bus protocol ($I^2C$), which microcontroller is in communication with an operator command to stop or run signal output circuit 82, a communication protection circuit 84 and a power supply 86. Microcontroller 80 includes a suitable EEPROM 80*a* for data storage. Suitable programming and communication schemes, including pulse width modulation, serial streams or analog techniques may be provided to accommodate the particular sensor circuit 76 being used. Circuits 82 and 84 are also operably connected to a microcontroller 88 of a barrier operator controller 90 which may be disposed within a suitable enclosure 92 mountable on frame 32 of operator 18, FIG. 1. Controller 90 may be mounted remotely and communicate with sensor circuit 76 via radio frequency wireless methods. A calibration and control circuit 94 may be included with controller 90 or removably connectable thereto. A main power supply 96 is operable to provide low voltage power to the sensor circuitry by way of power supply 86. Power supply circuit 96 is adapted to be included in operator controller 90 together with a motor control circuit 98 for controlling motor 34. The controller 90 may, in many respects, be similar to the barrier operator control systems disclosed in U.S. Pat. No. 6,118,243, issued Sep. 12, 2000, and U.S. Pat. No. 6,388,412 issued May 14, 2002, both to Reed et al. and assigned to the assignee of the present invention. The subject matter of U.S. Pat. Nos. 6,118,243 and 6,388,412 is incorporated herein by reference.

The above-described control system 73, including the magnetic position sensor 71, provides several benefits in a barrier operator. Absolute barrier position determination is possible, thanks to the output signal provided by sensor circuit 76 and after treatment by microcontroller 80. Position data is stored in memory 80*a* and may be communicated from sensor 71 to microcontroller 88 for various purposes. Door travel limits may be set by inputting signals through calibration pod 94 to microcontroller 88 and to microcontroller 80 correlating with position signals received from the position sensor circuitry. Moreover, in accordance with the invention, sensor 71 will determine or maintain information regarding barrier position if power to controller 90 is interrupted for any reason. Also, no homing or learning cycle is required after power is applied or reapplied. More precise control of the so-called safety cutout point may be provided, which point is that beyond which the barrier 10 may be driven to the closed position even though an external entrapment signal, for example, is received by the controller 90. Furthermore, as previously mentioned, the circuitry associated with the sensor circuit 76 may also be used to measure speed of travel of the barrier 10 and any changes in speed.

The magnetic position sensor 71 may receive two different messages from controller 90, periodically, such as every sixty milliseconds, via microcontrollers 80 and 88. A general broadcast message contains a running up flag, a running down flag, an up limit active flag, a down limit active flag, a mid-stop limit active flag, a reversing flag and an operator condition code. The magnetic position sensor 71 does not respond to a general broadcast message. A normal operation message is sent to the magnetic position sensor 71 including a magnetic position sensor direction correlation flag, a set up limit flag, set down limit flag, a set mid-stop flag and a calibration request confirmation flag. The magnetic position sensor 71 interprets this information and then responds with an update message after receipt of a controller normal operation message. During the time period between messages from the controller 90, the magnetic position sensor 71 will determine its current rotational position and rotational speed, calculate rolling averages of these values and store them for translation to the controller. These values will be continually updated until the controller's message is received and the sensor enters a reply mode.

The magnetic position sensor 71 is operable to receive a set limit command from the operator controller 90 wherein the set position is up, down or mid-stop. If the motor 34 of operator 18 is not running and a calibration request confirmation flag is set, the sensor 71 will store a current running average representing its current position but will not store the same position value for two different limit positions. Accordingly, if the operator controller 90 is running when the set limit command is sent or, if the current position has already been assigned to another limit, or the current position does not meet the requirements of the programmed values, the limit position will not be stored in memory but will send an unable-to-set-limit flag for the next communication cycle. If the calibration request confirmation flag is not set, the sensor 71 will ignore such request.

The sensor position value associated with a mid-stop limit must fall between values associated with an up and down limit position of the barrier 10. Accordingly, both the up and down limits must be set before the mid-stop limit can be set. The sensor 71 will set the up, down and mid-stop limit set flags if position values have been stored in memory for a given limit. These flags will be cleared if no value has been stored in the associated memory locations. The position sensor 71 will set a limit sensor direction flag equal to the current rotational direction of the sensor input shaft 68. Clockwise (CW) and counterclockwise (CCW) directions may be determined by viewing the sensor with the end of the input shaft 68 at which the magnet 70 is disposed facing the viewer. In conventional door operators determination of direction of rotation is also carried out by viewing the operator facing the operator output shaft. The comparison may be made initially between 250 and 500 milliseconds after the operator 18 begins moving the barrier 10. If the sensor 71 determines that the operator 18 is running in the wrong direction, the sensor will activate a stop run output signal to the controller 90 and also send a running wrong direction flag for two communication cycles until the aforementioned general message indicates that the operator 18 has stopped the barrier 10, whichever is longer. After completing this set of steps, stop run output and running wrong direction flags would be cleared.

It may be necessary to provide for adjustment of the gap between the sensor circuit element 76 and the magnet 70 to achieve the highest resolution signal. Such adjustment may be made by positioning the substrate 78 at selected positions on the spaced apart support bracket 77, FIG. 3. Alternatively, the position of the magnet 70 on shaft 68 may be adjusted to adjust the gap between the magnet face 70*a*, FIG. 4, facing the circuit element 76 and the face 76*a* of the circuit element facing the magnet.

When the sensor 71 indicates that the operator 18 is moving the barrier 10 in a particular direction, the sensor compares a rolling average signal (two-bytes, for example) representing the current position to a stored limit position. For example, if the operator 18 is running the barrier 10 toward a closed position, the current position of the barrier is compared to a predetermined barrier down or closed limit value. When the current position equals or exceeds the stored limit position value, the sensor 71 activates a stop run output signal and maintains it active for two communication cycles or until a broadcast message indicates that the operator 18 has achieved the desired limit position and has stopped the barrier 10, whichever is longer. After this process, the stop run output signal is cleared.

If a mid-stop limit position has been set, then when the operator 18 is running the barrier 10 toward the up or open position, the sensor 71 will consider the mid-stop limit to be the up limit and activate a stop run output signal. Sensor 71 will also activate a mid-stop limit active flag and if a run on to the barrier up limit position is initiated from the mid-stop limit, the sensor 71 will then use the up limit as normal. The mid-stop limit does not affect barrier travel in the down direction. However, a mid-stop limit active flag should be set as usual, if appropriate. If a mid-stop limit position is not set, it is ignored and any associated flag is left inactive.

As known to those skilled in the art, barrier operators, such as the operator 18, will not stop a barrier precisely at a given position. Accordingly, the magnetic position sensor 71 should, typically, consider a range of position values following the actual limit setpoint to be considered as an active limit setpoint. When the sensor position value is within the range set, it will set a corresponding limit active flag and the limit active flag will be cleared when the sensor current position is not within the corresponding range. All limit position values are stored in the aforementioned non-volatile memory.

The sensor 71 must account for crossing a zero boundary during operation. It is possible to set one limit at the extreme lower or upper limit of the measurement range and have the other limit set at the other limit of the range with normal operation crossing over a zero point of the range. This allows the limit positions to be set without regard for the position of the output shaft 68 with respect to the sensor's measurement range.

Figures 6A, 6B:
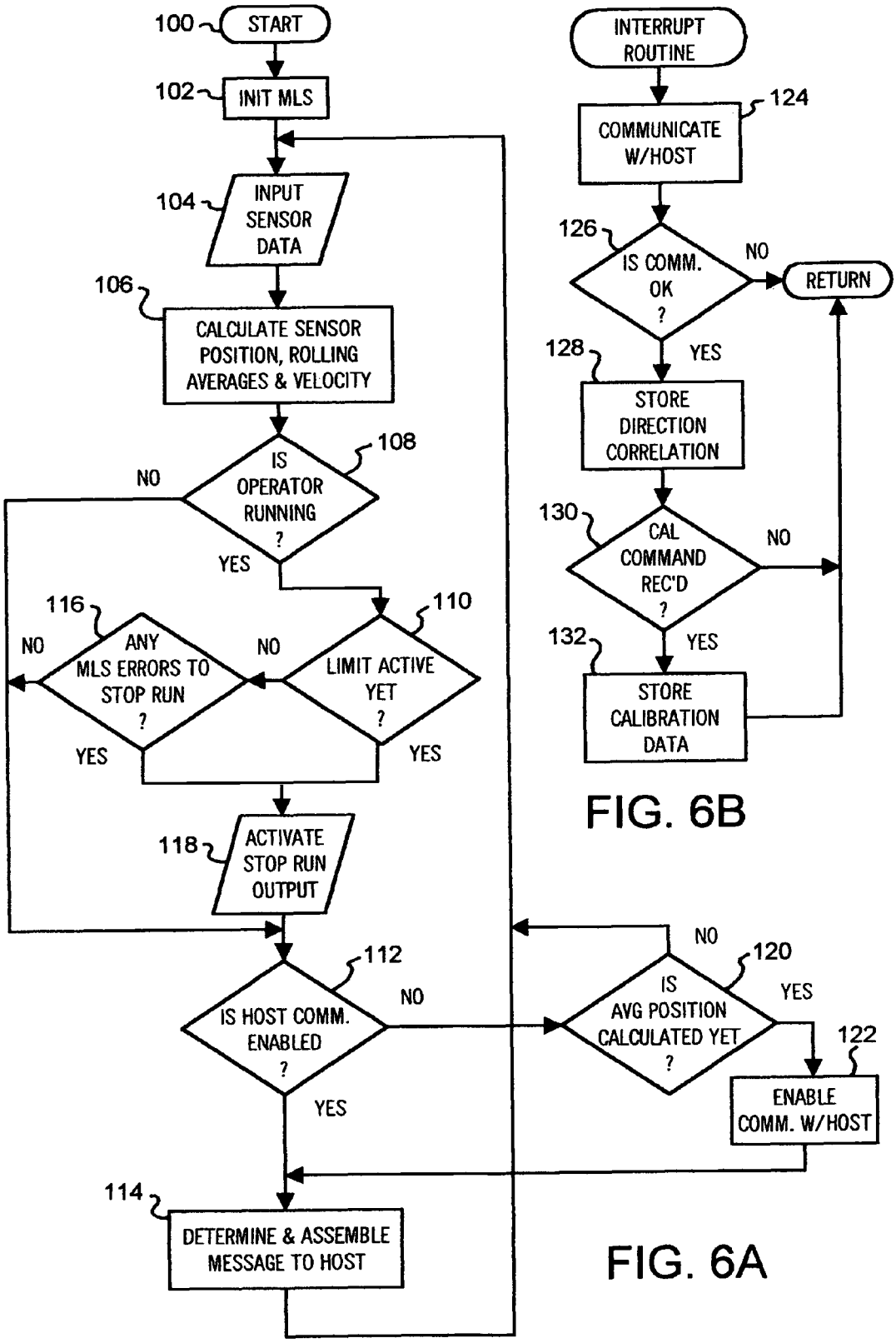
FIGS. 6A and 6B are flow diagrams illustrating major steps in a process of operation of an operator in accordance with the invention.

Referring to FIG. 6A, there is illustrated a flow diagram indicating at least certain major steps in the overall operation of the control system 73 and the sensor 71, in particular. Upon energization of the control system 73 at the start step 100, the sensor 71 will be initialized at step 102 and sensor data stored in memory 80*a* will be input to microcontroller 80 for calculation of sensor and barrier position, rolling averages and rotational speed which may be correlated with velocity of the barrier, these operations indicated by steps 104 and 106. The sensor 71 receives regular communication updates from the microcontroller 88 to determine if the operator 18 has been energized at step 108 and if so, to determine if a limit has been reached at step 110. If the operator 18 is not running at step 108 the process continues to step 112 to determine if communication with microcontroller 88 is enabled. If such is the case, the process continues to step 114 to determine and assemble a message to the microcontroller 88. The process then returns to step 104, as indicated.

Referring further to FIG. 6A, if at step 110 a limit position has not been reached, the microcontroller 80 queries itself for any error signals which may have been input from the magnetic sensor circuit 76 at step 116 and examines possible operator errors, including operation in the wrong direction with respect to that commanded and overrunning the operator limit positions, for example. If none are present, the process returns to step 108. If an error signal is present at step 116, the process proceeds to step 118 to activate a stop run output signal to be communicated to microcontroller 88. Of course, if a limit position has been reached at step 110 the same output signal from microcontroller 80 is communicated to controller 90 to cease operation of motor 34.

At step 112, if communication with the host microcontroller 88 is not enabled, the process queries the microcontroller 80 to determine if an average barrier position has been calculated at step 120. If not, the routine returns to step 104, as indicated in FIG. 6A. If an average position of the barrier has been calculated the microcontroller 80 is enabled to communicate with the microcontroller 88 at step 122 and a message is sent to microcontroller 88 at step 114.

FIG. 6B illustrates an interrupt routine, such as would be carried out as a consequence of every communication event with controller 90. The interrupt routine is commenced with communication with microcontroller 88 at step 124 and, if communication is confirmed at step 126, information correlating the direction of movement of the barrier with the process already programmed into the microcontrollers 88 and 80 is stored as indicated by step 128. If a calibration command signal is received at microcontroller 80 at step 130, calibration data is stored in the associated memories of microcontrollers 80 and 88 at step 132. If a calibration command is not received at step 130, the process returns to commencement of the interrupt routine.

As previously mentioned, the gear reduction (or increase) drive mechanism is operable to provide rotation of the magnet 70 up to 360° for the full travel of the barrier 10 between open and closed positions. In some instances, depending on the type of barrier operator, the gear speed or position change drive mechanism 52 may actually be a gear speed increase drive mechanism in order to achieve up to 360° of rotation of magnet 70 for the full range of barrier movement. Moreover, other power transmission means, such as chains or cogbelts or other positive, position for position, speed change mechanisms may be used to provide a precise relationship between barrier position and sensor 71. If the sensor 71 is permitted to run more than 360°, that is, cause magnet 70 to rotate more than 360°, so as to "wrap around" during any operation, the magnetic sensor circuit 76 will generate a signal to the microcontroller 80 which will provide flag signals at the stop/run output circuit 82 for two communication cycles or until a message or signal indicates that the operator 18 has stopped. The stop run output signal is then cleared and a limit sensor overrun flag is cleared when the operator 18 begins another movement after coming to a complete stop in acknowledgement of the limit sensor overrun flag. However, the system 73, including the sensor 71, may be modified to allow for and monitor rotation of the magnet 70 through more than 360° or more than one revolution of the magnet 70 while measuring speed and travel of barrier 10.

The microcontroller 80 receives data from sensor circuit 76 and its own memory 80*a* and calculates a running two-byte average of the current position and rotational speed of the shaft 68. The sensor 71 will then enable communication with the operator controller 90 as an $I^2C$ slave device and will have valid data to pass to the controller at its first communication. The sensor 71 is also operable to receive calibration commands from the controller 90 indicating which limit position is associated with the current position, for example. This command is only valid if the operator 18 is not moving the barrier 10 and the calibration request confirmation flag is set. Under these circumstances, the sensor 71 will store the current limit position in a memory of the microcontroller 80 and then send an appropriate limit set flag to the operator controller 90. If the operator 18 is still moving the barrier 10, the sensor 71 will send an unable to set limit flag and, for a given limit position, if a particular limit is already set, the receipt of a second limit command for that limit will clear the current limit position and store a new value. Such a process allows resetting of the limit position relatively easily. If a calibration request confirmation flag is not set, the sensor 71 will ignore the calibration request.

The sensor circuit 76, as mentioned previously, is mounted in proximity to the magnet 70 and the position of one or the other of these components relative to the other may be adjusted, as needed. Enclosure of these components, as described above and shown in FIG. 3, is important to protect the sensor and its associated circuitry. Electrical specifications may be in accordance with known practices for the manufacture and installation of electronic components. The communication protocol may be in accordance with standard $I^2C$ hardware, baud rates and generic data format. Transfer protocol, addresses and data formats may also be in accordance with known practices.

Figure 7:
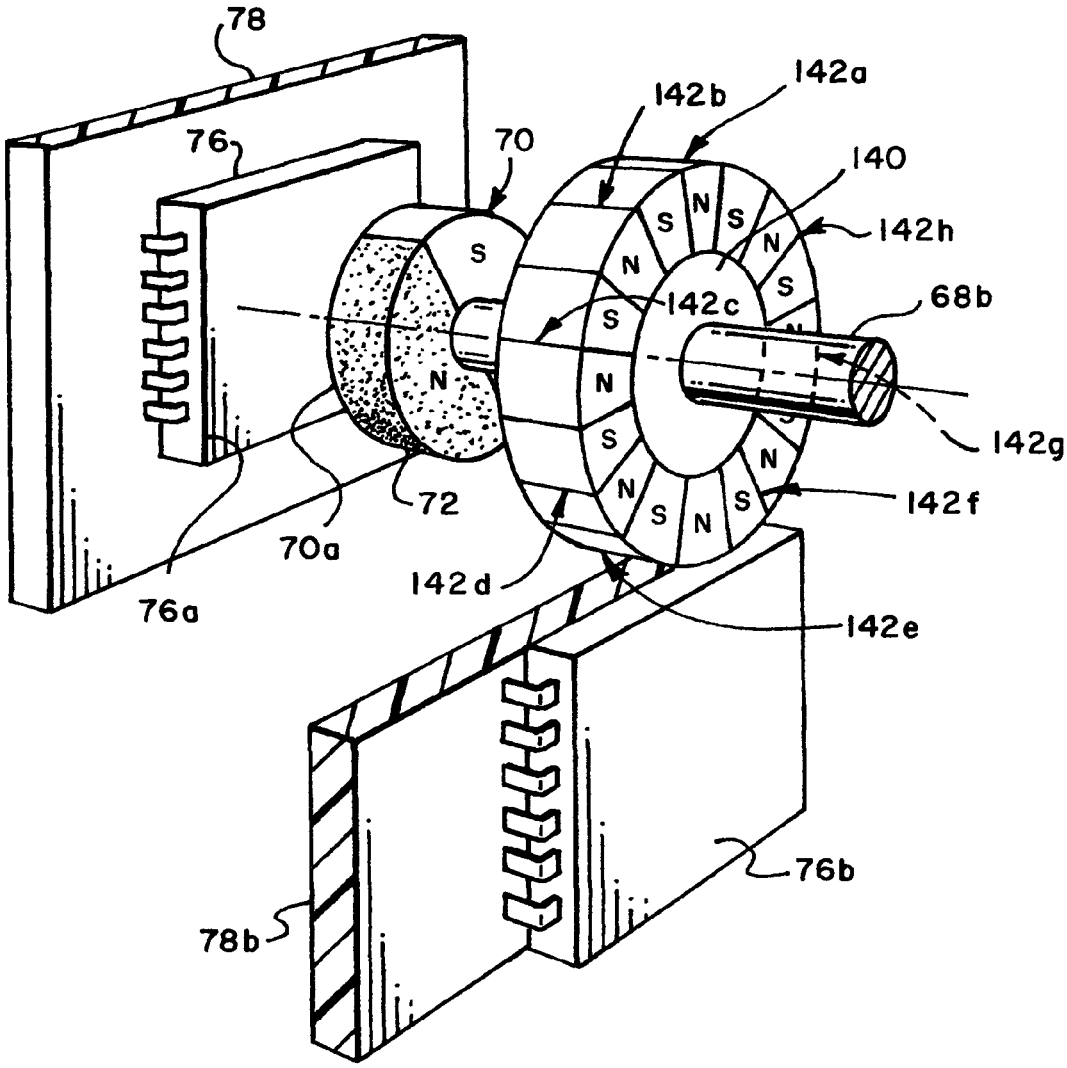
FIG. 7 is a perspective view of an alternate embodiment of the invention.

Referring briefly to FIG. 7, in certain applications of the control system 73, a higher resolution or more accurate determination of barrier position may be required. Accordingly, the control system 73 may be modified as to the sensor 71 by modifying shaft 68, as shown in FIG. 7 and designated by the numeral 68*b*, to accommodate a cylindrical member 140 supported on shaft 68*b* for rotation therewith. Member 140 supports a circumferential array of magnets 142*a*, 142*b* and 142*c* through 142*h*, each magnet having opposite N and S poles, as indicated by the illustration of FIG. 7. A second sensor circuit 76*b* is mounted on a suitable substrate 78*b* suitably supported within housing 56 or on a modified cover similar to cover 57 to accommodate the extra length of the shaft 68*b*, for example.

The multiple magnet sensor arrangement provided by the member 140, the circular ring array of magnets 142*a* through 142*h* and additional sensor circuit 76*b* provides for a "fine" or precise position measurement by producing additional electrical cycles of sine and cosine signals per revolution of shaft 68*b*. Accordingly, coarse information from the magnet 70, and the sensor circuit 76 mounted directly adjacent to the magnet 70, is used to locate which sector or magnet 142*a* through 142*h* is adjacent the second sensor circuit 76*b*. The accuracy of determining the position of the barrier 10 may be improved per one 360° revolution of the shaft 68*b* with suitable electronic calibration. The "coarse" and "fine" signals from the respective sensor circuits 76 and 76*b* may be processed by the microcontroller 80 to generate an output signal with significantly improved resolution and, hence, accuracy of barrier position determination. Alternatively, the multiple magnet sensor provided by the member 140 and the sensor circuit 76*b* mounted adjacent thereto may provide improved resolution or accuracy of position of the barrier 10 without the use of the magnet 70 and the sensor circuit mounted adjacent that magnet.

The present invention, except as otherwise described herein, may be fabricated and operated in accordance with known practices, using commercially available components and materials. Although preferred embodiments have been described in detail herein, those skilled in the art will also recognize that various substitutions and modifications may be made without departing from the scope and spirit of the appended claims.

What is claimed is:

1. In a motorized operator for moving a barrier between open and closed positions, a motor, a transmission drivenly connected to said motor, a barrier operably connected to said transmission for movement between open and closed positions in response to operation of said motor, and a controller;

said controller including a rotatable magnetic sensor operably connected to said operator to directly sense an angular position of a rotatable magnet of said sensor, and thereby make a direct determination of a position of said barrier and derive speed of said barrier from the determination of the position of said barrier;

a first microcontroller in communication with a sensor circuit of said rotatable magnetic sensor for receiving signals output from said sensor circuit and providing corresponding barrier position signals for effecting stopping movement of said barrier at one of an open limit position, a closed limit position, and a midstop position; and a second microcontroller operably connected to said first microcontroller for communicating position limit values to said first microcontroller for said one of said open position, said closed position and said midstop position.

2. The invention set forth in claim 1 including:

an operator stop/run output signal circuit connected between said microcontrollers.

3. The invention set forth in claim 1 wherein:

said second microcontroller includes a memory for storing values of at least one of rotational position of said magnet and rotational speed of said magnet.

4. The invention set forth in claim 1 wherein:

said microcontrollers are interconnected by a communication circuit and said second microcontroller is operable to send position limit command signals to said first microcontroller for setting limit positions of said barrier.

5. The invention set forth in claim 1 including:

means for adjusting the position of said magnet with respect to said sensor circuit to change the resolution of signals generated by said sensor circuit in response to rotation of said magnet.

6. The invention set forth in claim 1 wherein:

said first microcontroller is in communication with another sensor circuit of another rotatable magnetic sensor having another rotatable magnet for receiving signals output therefrom and for correlating signals from said other sensor circuit with signals from said sensor circuit for generating a barrier position signal.

7. The invention set forth in claim 6 wherein:

said magnet and said other magnet are mounted on a common shaft for rotation therewith.

8. A garage door position determination system, comprising:

a garage door movable along spaced apart guide tracks between an upward, fully open, position and a lower, fully closed, position;

a door operator comprising an electrical drive motor connectable through a drive mechanism to said garage door for movement of said garage door between said fully open and closed position, said operator including at least one rotatable shaft operable, in response to movement of said garage door between the upward, fully open, position and the lower, fully closed, position, to rotate through an angular displacement limited to about 360°;

a door operator controller, including a first microcontroller, for controlling the operation of said electric motor;

one or more magnets attached to said rotatable shaft whereby the rotation of said shaft creates a rotating magnetic field;

magnetic position sensor circuitry comprising Hall effect sensors, disposed adjacent said one or more magnets and within said rotating magnetic field, for producing output signals directly representative of the rotatable position of said rotatable shaft and thereby said position of said garage door;

wherein said output signals of said magnetic position sensor circuitry routed to said first microcontroller are indicative of at least one of the absolute position of the garage door, notification of the arrival of the garage door at a previously learned upper or lower limit, direction of garage door travel, or speed of travel of the garage door between upper and lower limits;

wherein the speed of travel of said garage door is derived from the determination of the position of said garage door; and wherein the magnetic position sensor circuitry additionally comprises a second microcontroller operable to determine the angular position of said rotating magnetic field and said rotatable shaft.

9. In a motorized operator for moving a barrier between open and closed positions, a motor, a transmission drivenly connected to said motor and operably connected to said barrier to effect movement of said barrier between said open and closed positions in response to operation of said motor, and a controller;

said controller including a rotatable magnetic sensor operably connected to said operator to directly sense an angular position of a rotatable magnet of said sensor, and thereby make a direct determination of a position of said barrier and derive speed of said barrier from the determination of the position of said barrier;

a first microcontroller in communication with a sensor circuit of said rotatable magnetic sensor for receiving signals output from said sensor circuit and providing corresponding barrier position signals for effecting stopping movement of said barrier at one of an open limit position, a closed limit position, and a midstop position; and a second microcontroller operably connected to said first microcontroller for communicating position limit values to said first microcontroller for said one of said open position, said closed position and said midstop position.

* * * * *